US006907914B1

(12) United States Patent
Lundh

(10) Patent No.: US 6,907,914 B1
(45) Date of Patent: Jun. 21, 2005

(54) LOCKING DEVICE

(75) Inventor: Jöran Lundh, Sarlavagen 16, Jonkoping (SE)

(73) Assignee: Jöran Lundh, Jönköping (SE)

( * ) Notice: Subject to any disclaimer, the term of this patent is extended or adjusted under 35 U.S.C. 154(b) by 0 days.

(21) Appl. No.: 10/239,124

(22) PCT Filed: May 5, 2000

(86) PCT No.: PCT/SE00/00893

§ 371 (c)(1),
(2), (4) Date: Sep. 18, 2002

(87) PCT Pub. No.: WO01/86104

PCT Pub. Date: Nov. 15, 2001

(30) Foreign Application Priority Data

May 31, 2000 (SE) ..... 0002030
Sep. 15, 2000 (SE) ..... 0003279
Dec. 11, 2000 (SE) ..... 00045552

(51) Int. Cl.[7] ..... E06B 9/56

(52) U.S. Cl. ..... 160/301; 160/238; 160/302; 256/24; 403/105

(58) Field of Search ..... 160/301, 300, 160/302, 303, 238; 256/1, 24; 403/105

(56) References Cited

U.S. PATENT DOCUMENTS 3,841,747 A * 10/1974 Peroutky et al. ..... 353/27 R
4,108,395 A * 8/1978 Heath ..... 242/385.3
4,420,127 A * 12/1983 Kondziola et al. ..... 242/378.4
4,509,708 A * 4/1985 Fohl ..... 242/385.2
4,519,652 A * 5/1985 Kamijo ..... 297/477
4,684,077 A * 8/1987 Kurtti et al. ..... 242/384.2
5,192,035 A * 3/1993 Dufour ..... 242/384.5
5,263,422 A * 11/1993 Barefoot ..... 105/308.1
5,359,921 A * 11/1994 Wolff et al. ..... 89/169
5,639,129 A * 6/1997 Lindley ..... 292/145
5,690,317 A 11/1997 Sandsborg
6,055,823 A * 5/2000 Baker et al. ..... 62/265
6,364,154 B2 * 4/2002 Kruzick et al. ..... 220/813
6,375,165 B1 * 4/2002 Sherratt et al. ..... 256/24
6,461,090 B1 * 10/2002 Faber et al. ..... 410/100
6,463,773 B1 * 10/2002 Dimig ..... 70/277

* cited by examiner

*Primary Examiner*—Bruce A. Lev
(74) *Attorney, Agent, or Firm*—Merchant & Gould P.C.

(57) ABSTRACT

A locking device for a safety gate which includes a gate surface made from material which may be wound up with a mechanism for prevention of unintentional unwinding of gate material, the mechanism including a catch wheel which co-rotates with the unwinding, a rotatable catch for cooperation with the cogs of the catch wheel and a release mechanism releasing the gate for unwinding. The mechanism also includes a driver which is arranged adjacent the catch wheel and may be rotated concentrically therewith, at which rotation a pin which is arranged at the catch is displaced in a slot in the driver so that the pin, when the catch is in a released position, contacts a surface inside or adjacent the slot. The driver includes a fork with two shanks between which the slot is arranged. The slot is L-shaped. In order to release the gate, a manually performed movement in three different directions of an actuator which affects the releasing mechanism is required. The locking mechanism is affected and the release occurs only at the movement in the last of the directions. The actuator includes a moveable first button and a second button which may be displaced at a right angle to the direction of displacement of the first button.

2 Claims, 12 Drawing Sheets

LOCKING DEVICE

The present invention is for a locking device for roller mechanism. The locking device is primarily intended to be used with safety gates made from plastics and/or textiles. The function of the locking device is to make unwinding of the material only when the locking device has been released. Winding up of the material is preferably by means of a spring mechanism of the same type as for roller blinds.

Safety gates of the kind for which the invention is intended to be used are mainly used as child safety gates to prevent small children to for example get out into staircases. Thus the safety gates ought to be easily opened by a grown up person or an older child but opening shall include acts which a small child is unable to perform. When the gate is closed the material is unwound from the roll which is vertically mounted at one side of the opening and the outer edge of the gate is in a suitable way fixed at the other side of the opening. If the gate is then actuated in some way, for example pressure on the surface of the gate, then the locking device shall prevent further unwinding of material.

The procedure when an opening is to be closed using by the gate then is that the locking device first is released, then the gate is pulled out without any return motion and the outer edge is fixed. The gate may be released by external actuation which causes movements that affect control buttons at the locking device to several consecutive movement in different directions. The control buttons are connected to one another so that an outer button surrounds an inner button and the release of the locking device takes place by that both buttons together are pushed in a direction towards the axis of the winding mechanism and the center of the device whereupon the inner button is pushed don and both buttons then are together pushed away from the centre and released. The buttons have such an outer shape that necklaces, strings, bands and similar things can not be caught by them.

The locking device according to the invention and embodiments thereof have the characteristic properties which are mentioned in the claims.

The invention will below be described more in detail with reference to the example of an embodiment thereof which is shown in the enclosed figures.

Figure 1:
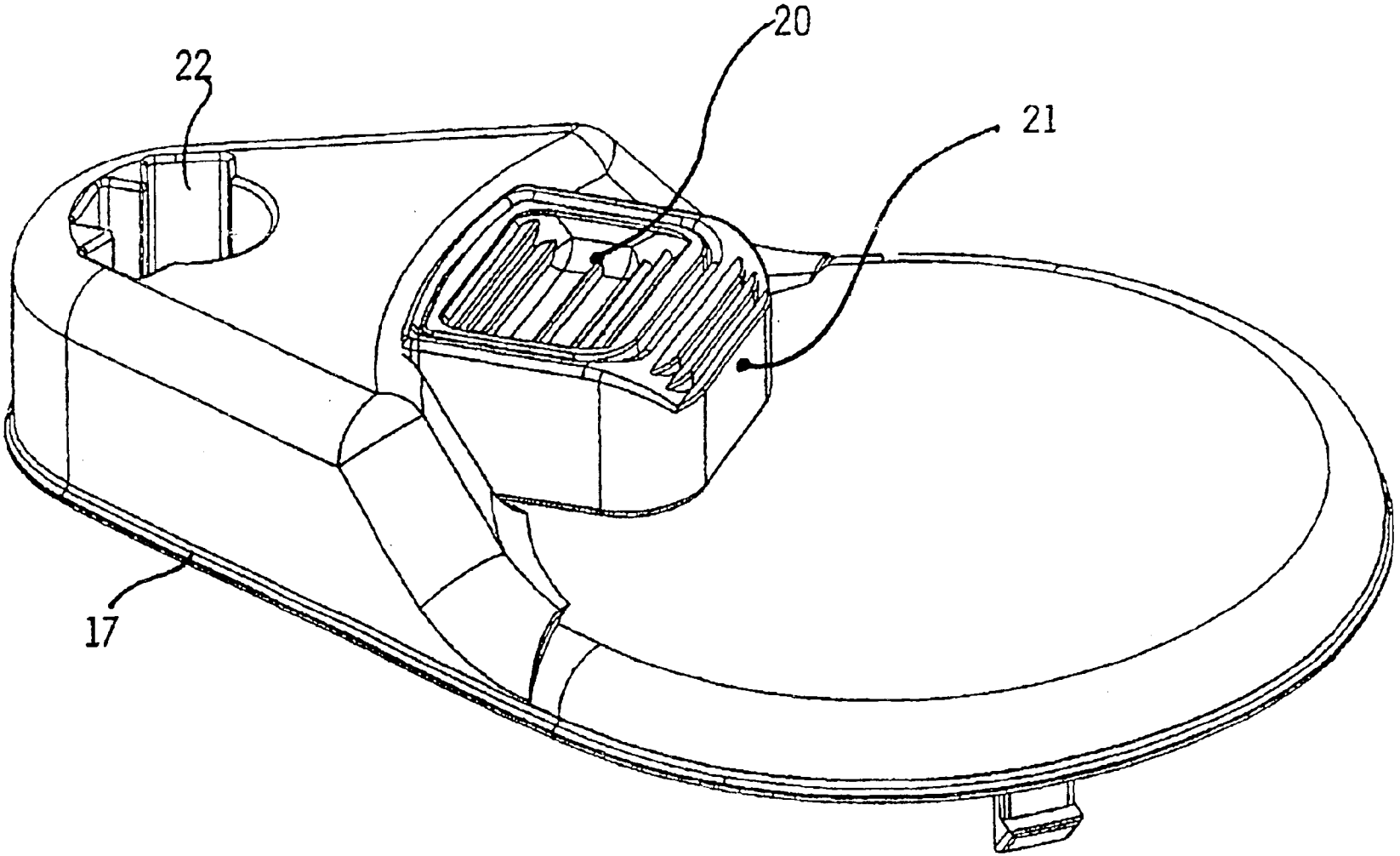
FIG. 1 shows the outside of the upper section of the housing of a locking device.
Figure 2:
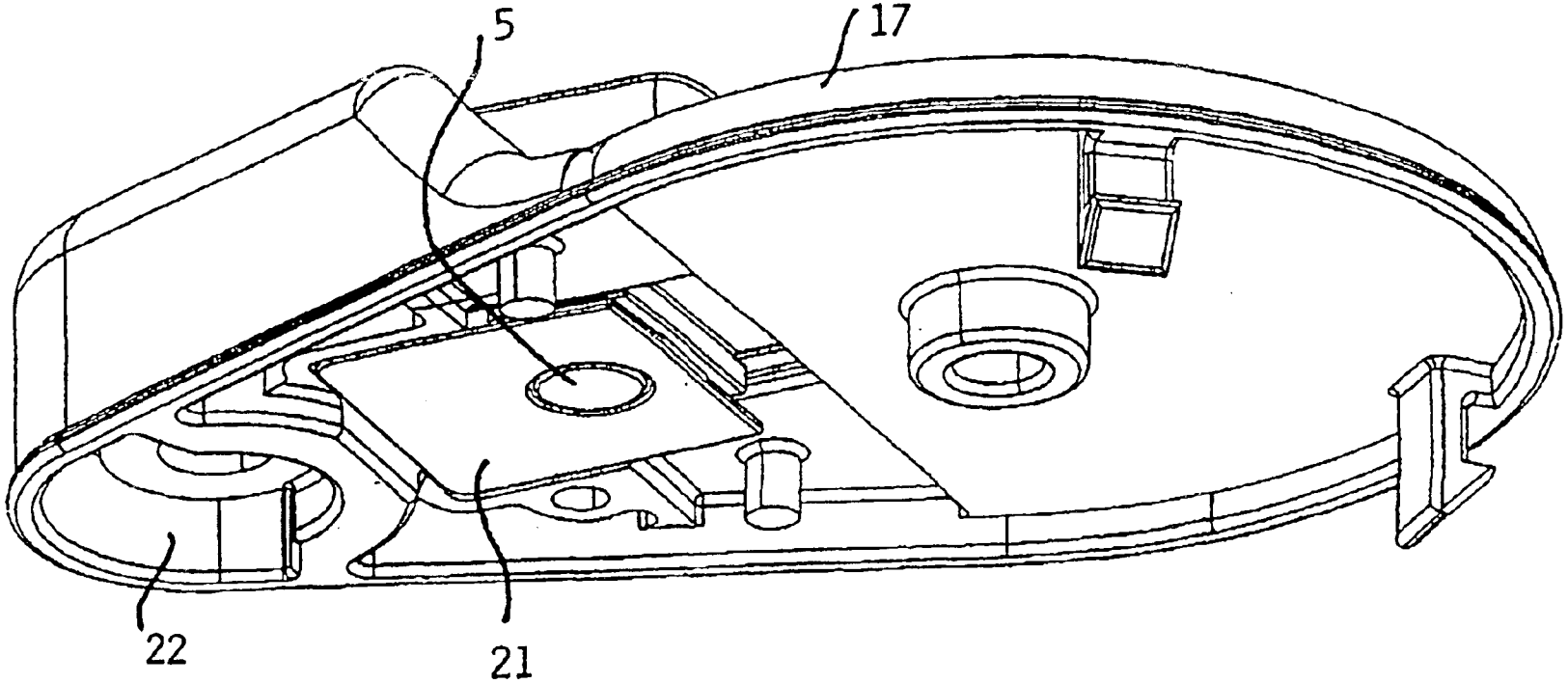
FIG. 2 shows the inside of the upper section of the housing of FIG. 1.
Figure 3:
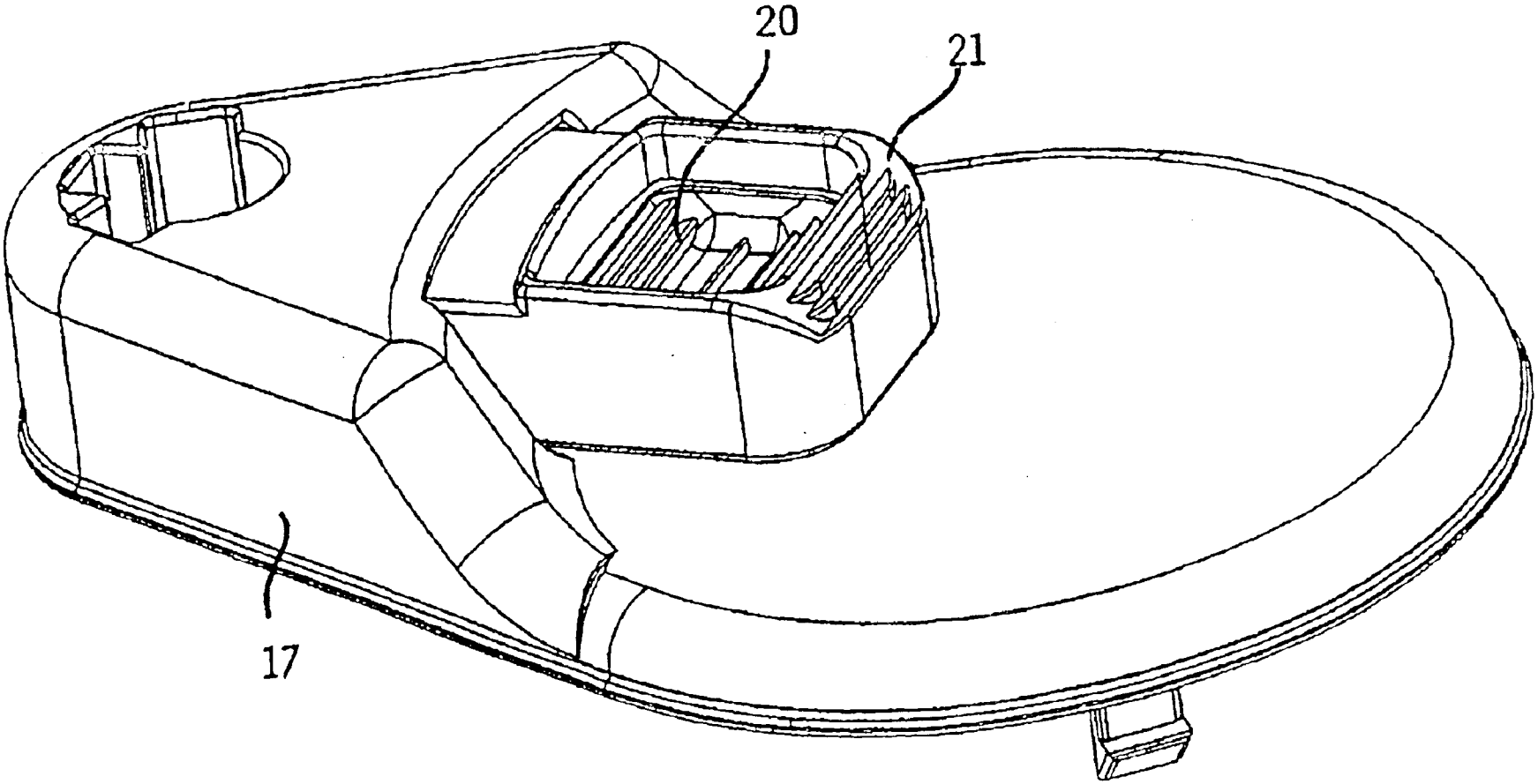
FIG. 3 shows the upper section of FIG. 1 with the pushbutton pushed forward.
Figure 4:
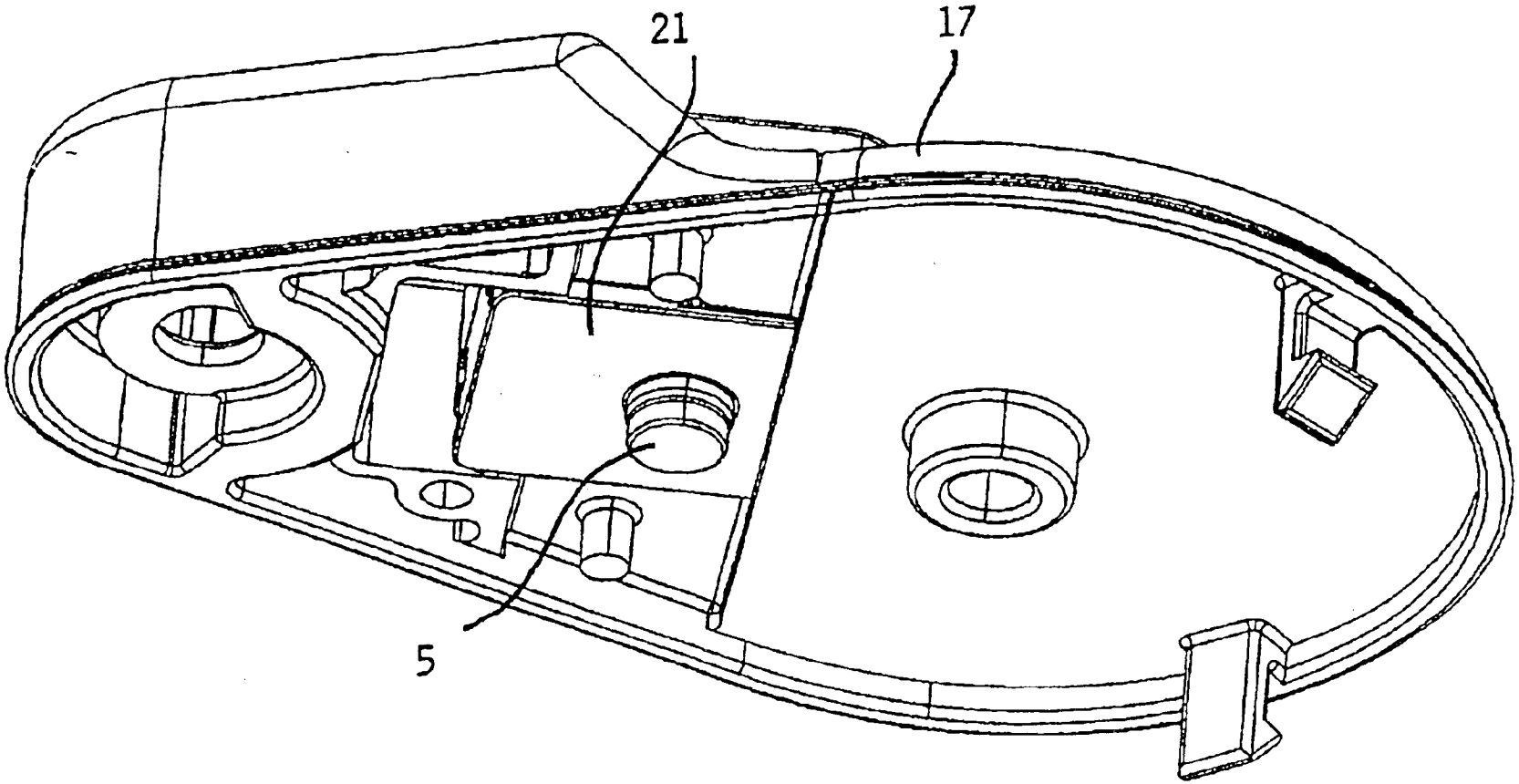
FIG. 4 shows the upper section of FIG. 2 with the pushbutton pushed forward.
Figure 5:
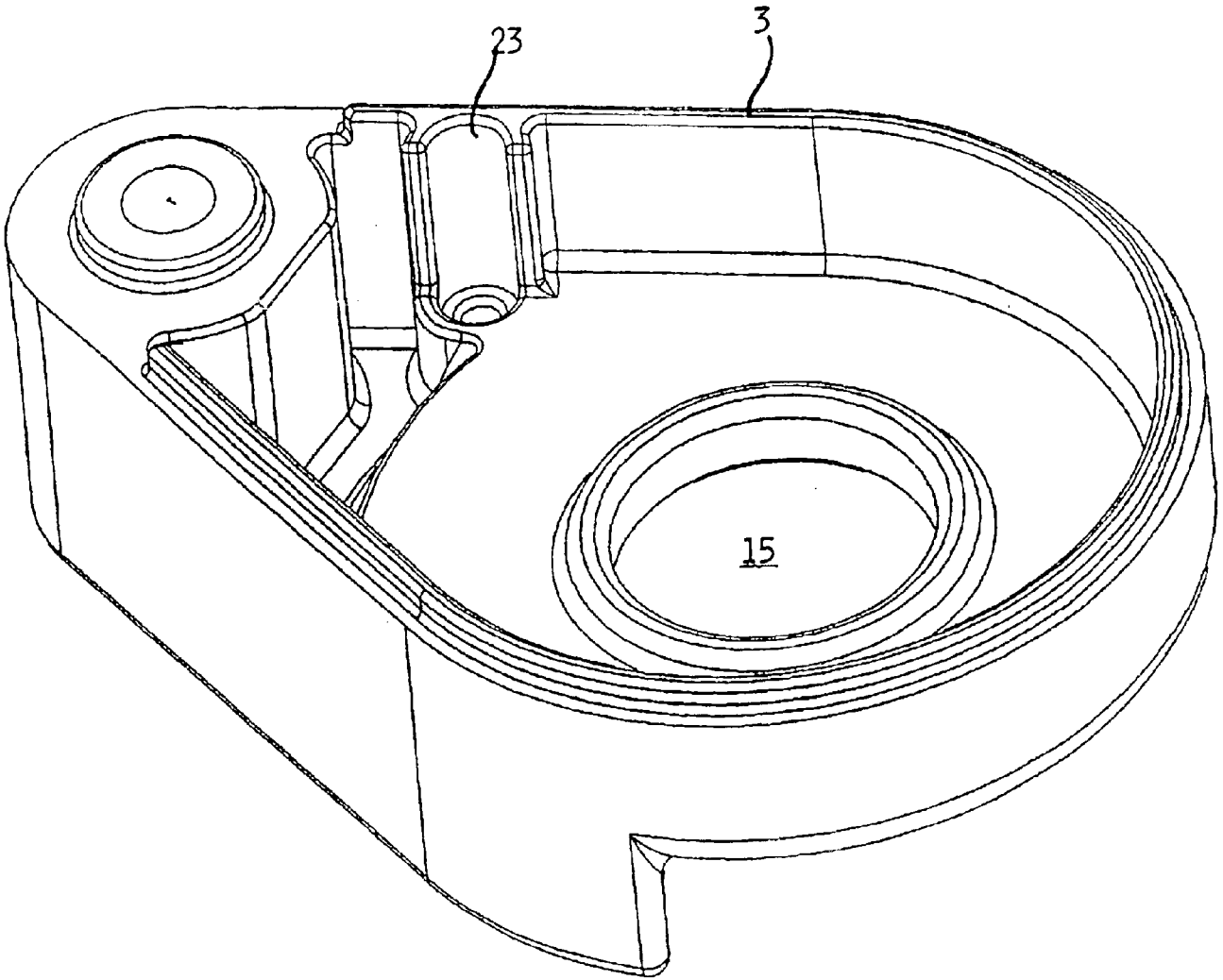
FIG. 5 shows the inside of the lower section of the housing of the locking device.
Figure 6:
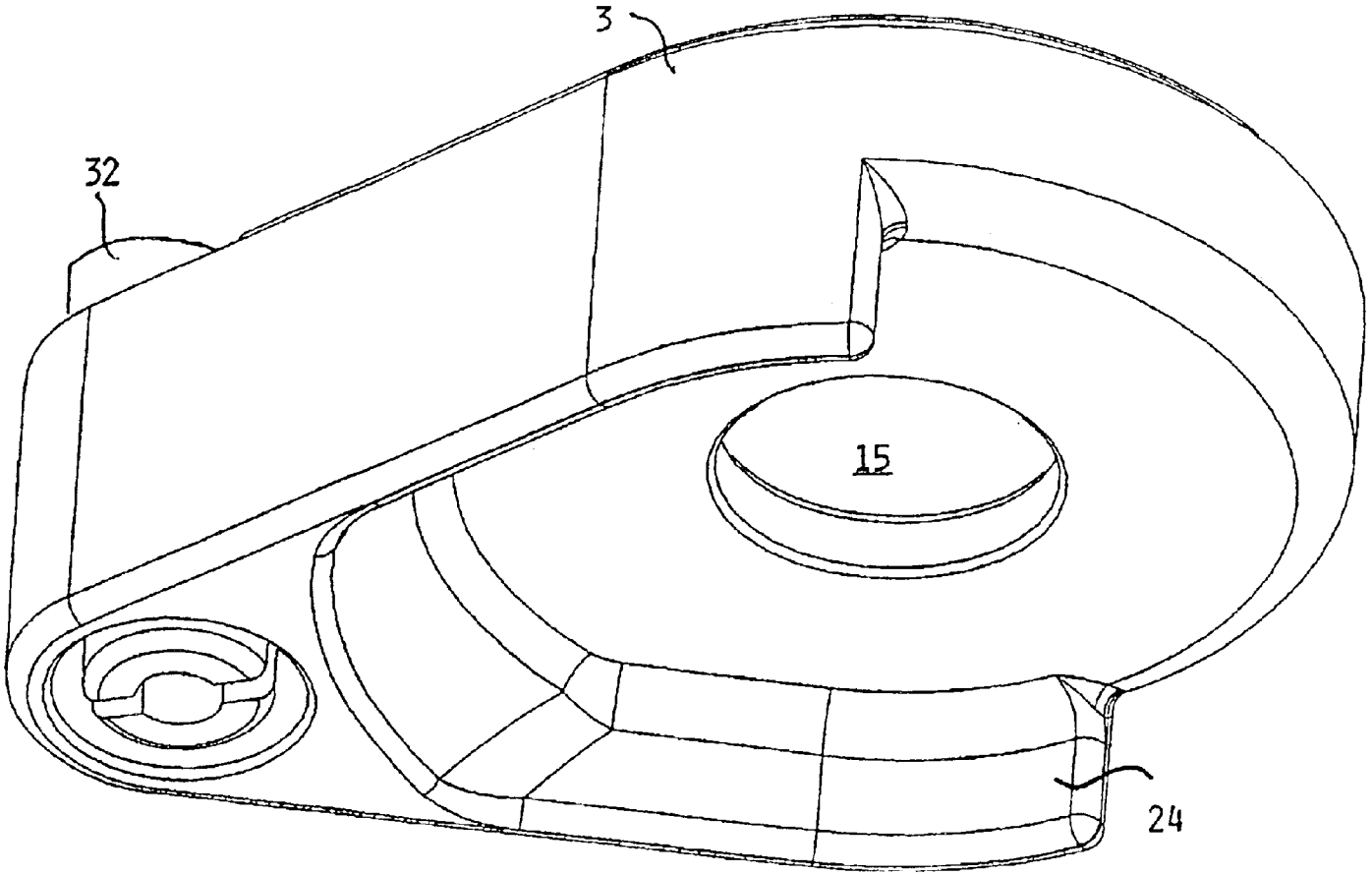
FIG. 6 shows the outside of the lower section of the housing of the locking device.

The locking device comprises a housing having an upper section 17 and a lower section 3.

The safety gate is for example mounted between two gate-posts 27, 28. A mounting tube 29 is mounted to the first gate-post 27 and has at its upper end the housing sections 3, 17 of the locking device and at its lower n a bearing 30 for the tube on to which the gate 26 may be wound up. In the figure the gate is shown pulled out to the second gate-post 28 and fixed thereto in a known manner which is not shown in the figure.

Figure 7:
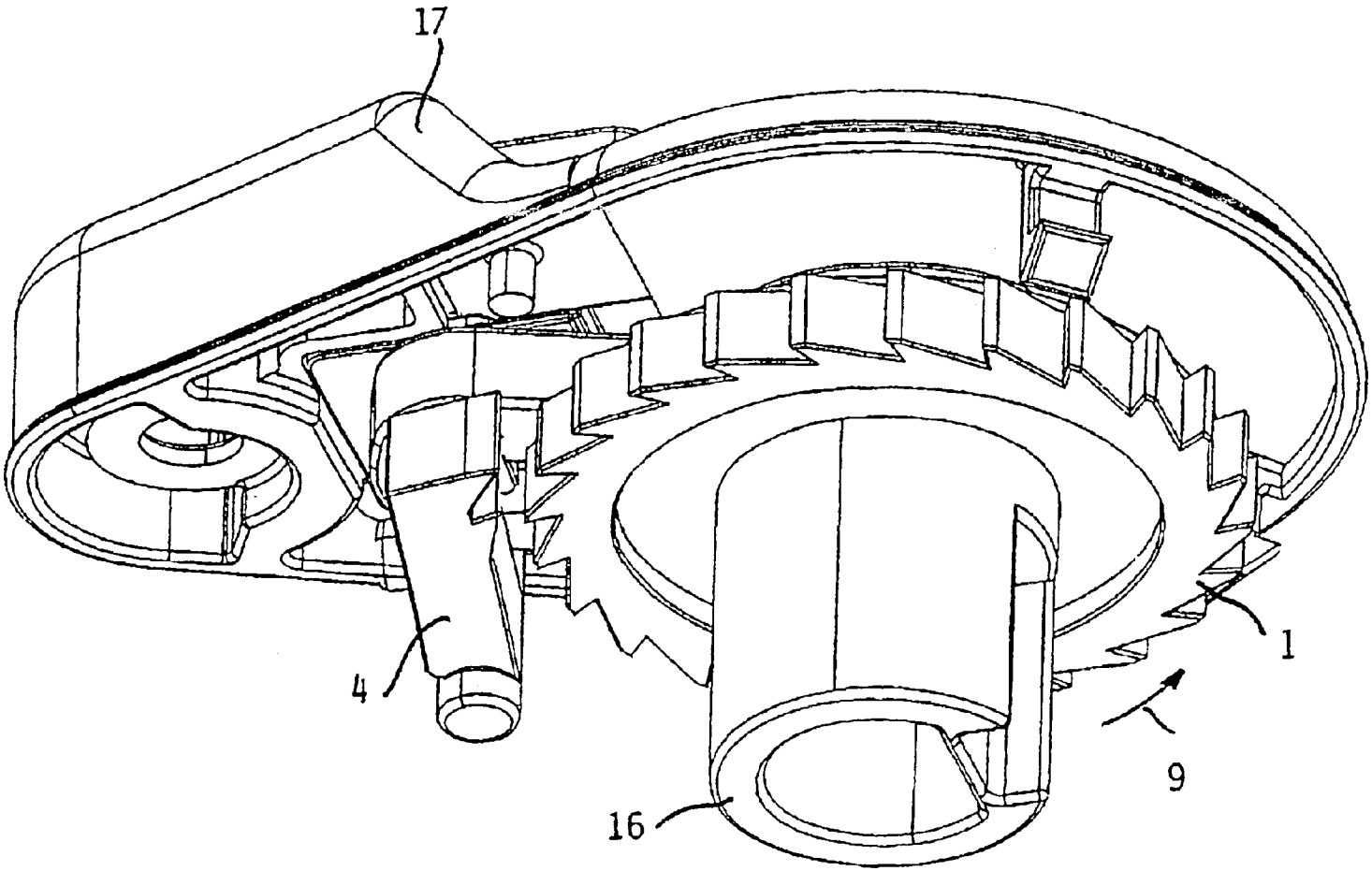
FIG. 7 shows the upper section of the locking device with the locking mechanism in a released position.
Figure 8:
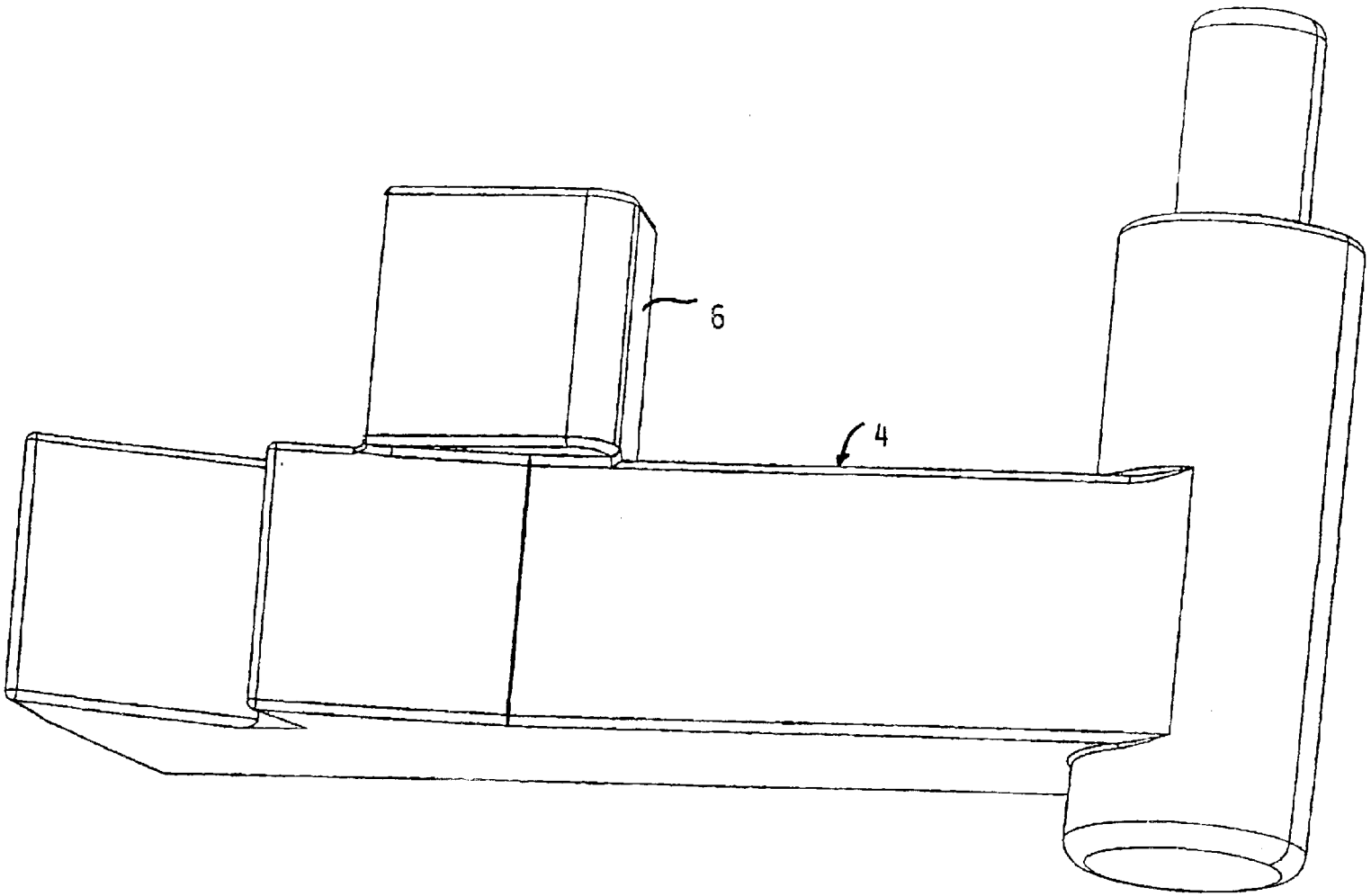
FIG. 8 shows the catch of the locking device.

The material of the safety gate may be wound up on a rod or tub in a way similar to that of a roller blind and having a return spring of the same kind as a roller blind. There is however an essential difference in the function in that, as described above, the safety gate must not be unwound unintentionally but this requires the release of a locking device. In the example which is shown in the figures the gate is wound up to or unwound from a roller 31 which is mounted to the shaft en 16 of the cog wheel 1 and bears in the lower bearing 30. The cog wheel 1 has a bearing in the upper section 17 of the housing and by means of the shaft end 16 in the hole 15 in the lower section of the housing. At unwinding the cog wheel rotates in the direction which is shown by a bent arrow in FIG. 7. This rotation, and consequently also further unwinding of material, is barred when the catch 4 intersects with the cog wheel. The member is rotatably born in bearing means 23 which are arranged for this purpose in the lower section 3 of the housing and corresponding in the upper section of the housing. The catch 4 is forced inwards towards the cog wheel by a spring 8 which forms an integrated part of the member and which is in contact with the bushing 32 in the lower section 3 of the housing.

Figure 9:
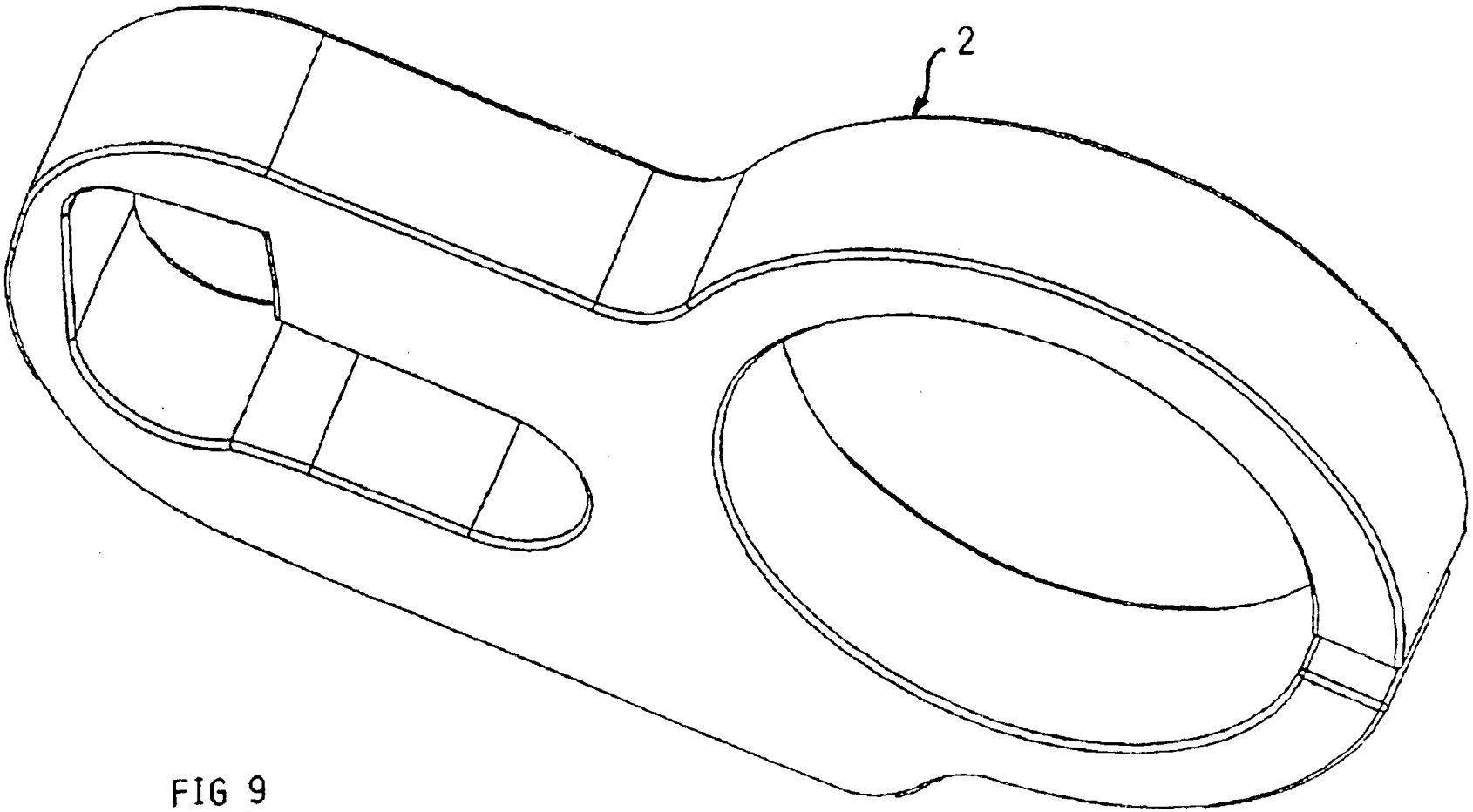
FIG. 9 shows the driver of the locking device.
Figure 10:
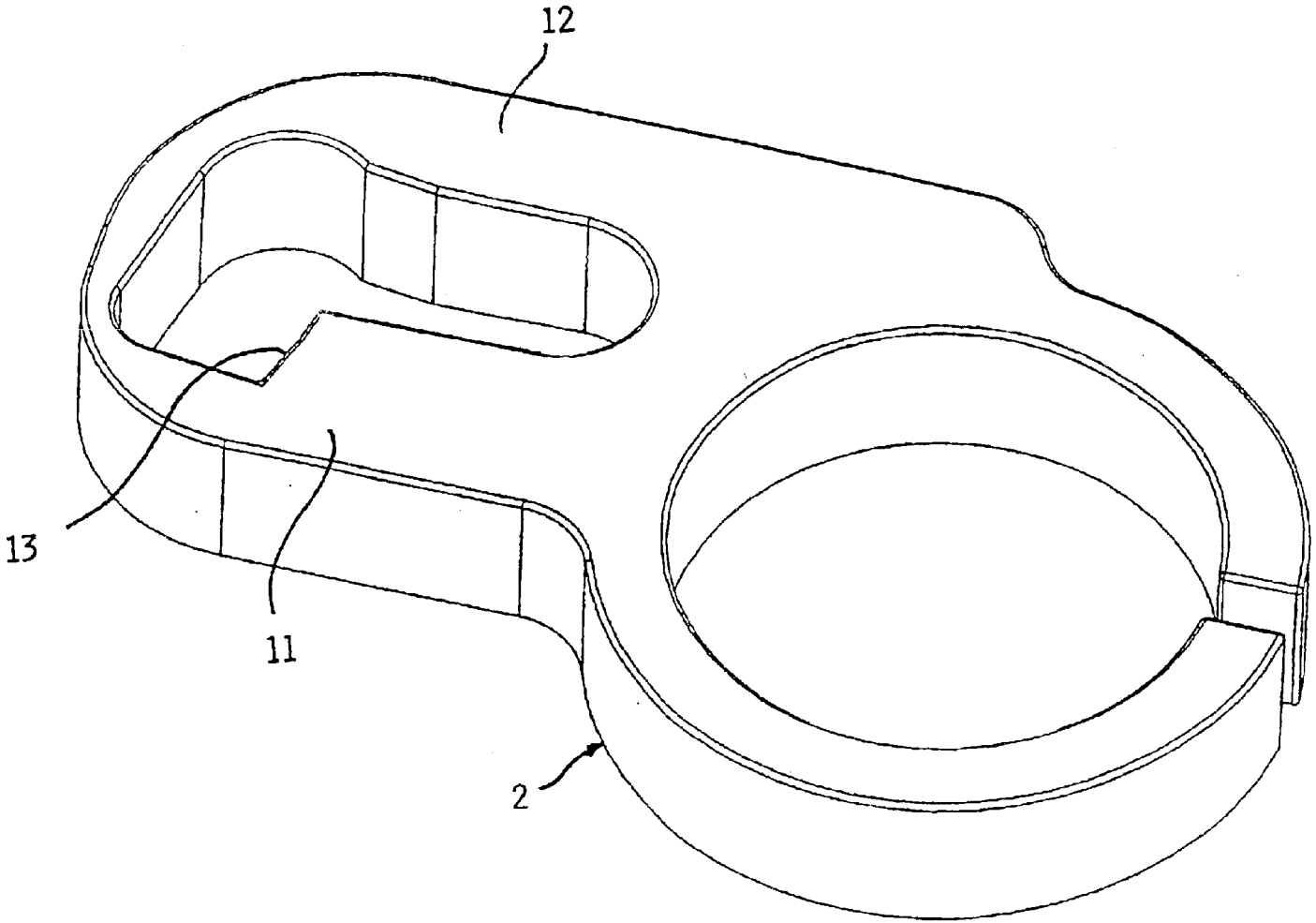
FIG. 10 shows a second view of the driver.
Figure 11:
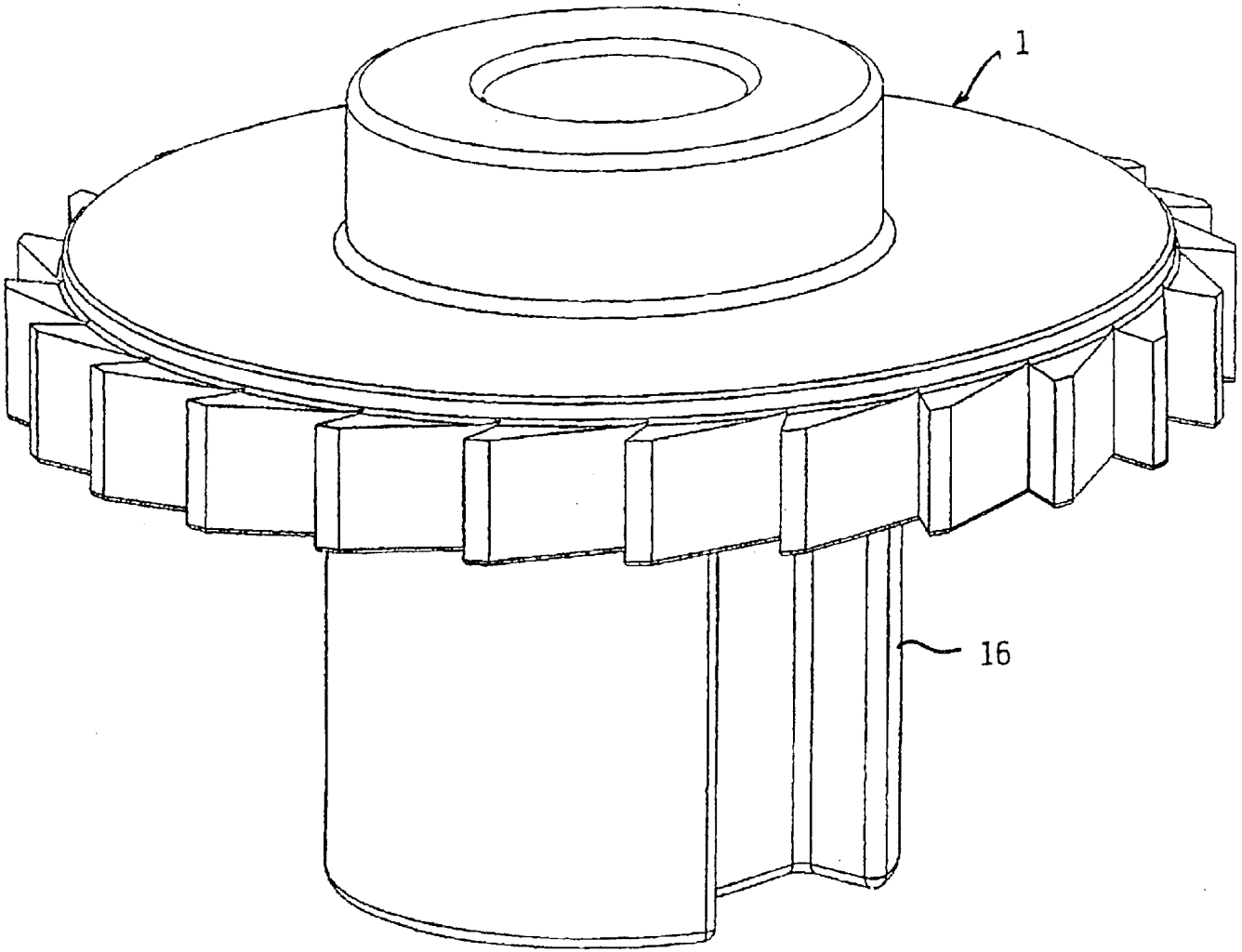
FIG. 11 shows the cog wheel and its shaft end.
Figure 12:
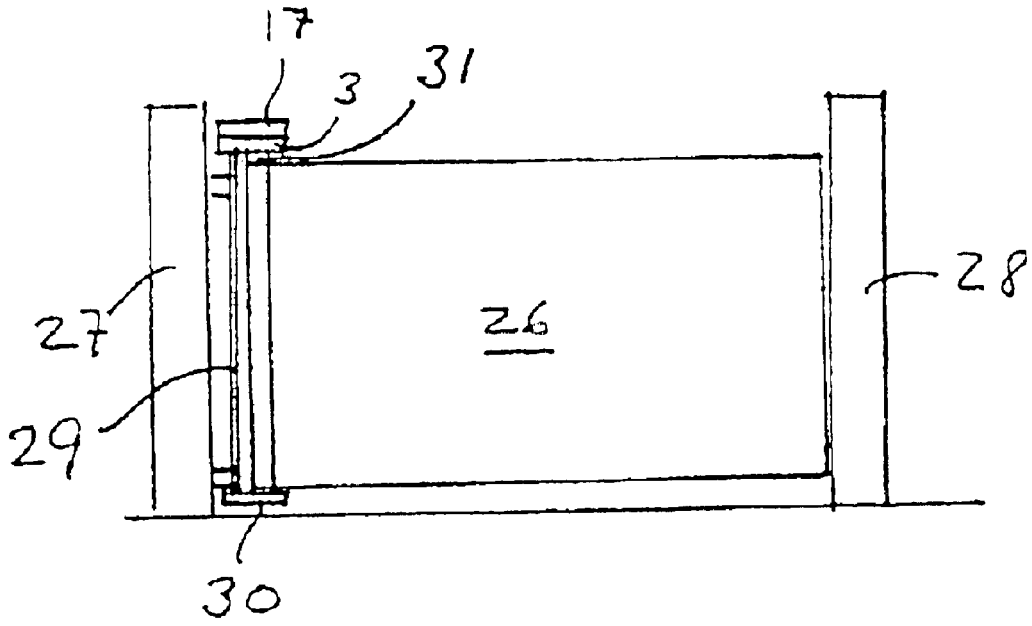
FIG. 12 shows a mounted safety gate having a locking device according to the invention in principle.

The catch 4 may be kept in a position where the cog wheel is released by means of a driver 2 which is rotatably mounted at a shaft end at the cog wheel so that the driver 2 is positioned between the cog wheel and the upper section 3 of the housing. The driver 2 has a fork which is formed by two shanks or arms, one short arm 11 and one longer arm 12 and between the arms a slot which is delimited by the essentially parallel inner surfaces of the shanks. The shanks are so directed that their inner surfaces and the extensions thereo form an acute angle to a radius through the center point of the turning of the driver, where the extension of the radius will pass through the outer surface 13 of one of the shanks. The locking device is released and unwinding of the gate 26 is enabled when the pin 6 of the catch is in contact with the outer, flat surface 13 of the short arm 11. In other embodiments of the invention the shanks may be joined together by means of a connecting outer member as shown in FIGS. 9 and 10. The slot of the driver is then L-shaped and the short shank of the slot corresponds to the outer surface of the short shank 11 of the said fork. I a released position the driver rests at one side surface of this short shank of the L-slot In order to enable unwinding of the gate which is wound up on the roll 31 it is as mentioned above necessary to release the locking device. To achieve this the catch 4 shall be moved away from the cog wheel and the driver 2 shall be displaced so that the catch is in contact with the short arm 11 of the driver. This is achieved by means of an actuating mechanism having press and push buttons, first button 21 and a second button 22, at the top side of the housing. For the release a manually brought about movement of the buttons in three different directions as follows is required. After that the buttons have been pushed (to the right in FIG. 1) and the button 20 is pressed down then the locking mechanism be affected by the pin 5 at the button 20. The buttons are then together pushed back to the starting position which causes the catch to be displaced to a released position and the pin 6 of the catch then is in contact with the outer end of the short arm 11. As long as unwinding is going on there is no change of the situation of the locking device but as soon as the gate is slightly returned then the driver 2 is actuated by friction against the cog wheel and the shaft end at which the driver is placed so that the device returns to locked position and the pin 6 at the catch 4 is in the slot between the arms 11 and 12 of the driver.

What is claimed is:

1. A device comprising:

a safety gate mounted between two gate posts and defining a gate surface including material that can be wound; and a locking mechanism coupled to one of the two gate posts and configured to prevent unwinding of the gate, the locking mechanism including:

a catch wheel including cogs and configured to rotate with the gate when the gate is unwound;

a rotatable catch cooperating with the cogs of the catch wheel;

a release mechanism for releasing of the gate for unwinding;

a driver adjacent the catch wheel that rotates concentrically therewith; and a pin arranged at the catch that is displaced in a slot defined by the driver so that the pin, when the catch is in a released position, contacts a surface inside or adjacent the slot, wherein the slot is L-shaped.

2. A device comprising:

a safety gate mounted between two gate posts and defining a gate surface including material that can be wound; and a locking mechanism coupled to one of the two gate posts and configured to prevent unwinding of the gate, the locking mechanism including:

a catch wheel including cogs and configured to rotate with the gate when the gate is unwound;

a rotatable catch cooperating the cogs of the catch wheel;

a release mechanism for releasing of the gate for unwinding;

a driver adjacent the catch wheel that rotates concentrically therewith; and a pin arranged at the catch that is displaced in a slot defined by the diver so that the pin, when the catch is in a released position, contacts a surface inside or adjacent the slot, wherein, in order to release the gate, a manually performed movement in three different directions of an actuating means which affects the release mechanism is required; and wherein the actuating means comprises a moveable first button and therein arranged a second button which can be displaced at a right angle to a direction of displacement of the first button.

* * * * *